United States Patent [19]

Marechal

[11] 3,984,170

[45] Oct. 5, 1976

[54] ELECTRICAL EQUIPMENT TERMINALS OR CONNECTING MEMBERS

[75] Inventor: Gilles Marechal, Paris, France

[73] Assignee: S.E.P.M. (Societe Anonyme), Paris, France

[22] Filed: Nov. 10, 1975

[21] Appl. No.: 630,625

[30] Foreign Application Priority Data

Nov. 13, 1974 France ..... 74.37359

[52] U.S. Cl. ..... 339/255 R; 339/272 R

[51] Int. Cl.[2] ..... H01R 13/16

[58] Field of Search ..... 339/255, 272, 48, 49 B

[56] References Cited

UNITED STATES PATENTS

| | | | |
|---|---|---|---|
| 2,123,506 | 7/1938 | Frankel, Jr. | 339/272 UC |
| 3,816,817 | 6/1974 | Ball et al. | 339/272 R |

FOREIGN PATENTS OR APPLICATIONS

| | | | |
|---|---|---|---|
| 1,054,136 | 4/1959 | Germany | 339/272 UC |
| 1,389,301 | 4/1975 | United Kingdom | 339/255 R |

*Primary Examiner*—Joseph H. McGlynn
*Attorney, Agent, or Firm*—Edwin E. Greigg

[57] ABSTRACT

An electrical equipment terminal or connecting member is designed to clamp and lock elastically the bared end of a supply or distribution cable. It comprises a cylindrical core with constant cross-section, an elastic ring of cross-section conjugate with that of said core and adapted to encircle the core, and a clamping screw engaged in a diametric tapping of the core after having traversed a conjugate opening of the ring. A longitudinal cavity of the core starting from its side opposite the tapping and whose plane of symmetry passes through the axis of the tapping defines with a portion of the inner surface of the ring, a housing to conductively contact the bared end of the cable. The elements are all of cupriferous metal. The invention is especially advantageous in an electrical end pressure contact connector.

10 Claims, 5 Drawing Figures

ELECTRICAL EQUIPMENT TERMINALS OR CONNECTING MEMBERS

BACKGROUND OF THE INVENTION

1. Field of the Invention

The invention relates to improvements in or to terminals provided on electrical equipment or the male and female members of a plug connector and intended to receive and to hold the end of an electrical supply or distribution cable.

2. Description of the Prior Art

To fix the end of a cable in a bushing, a great many devices have been devised.

The simplest of them comprise a simple clamping screw, with overlapping head, screwed transversely through the wall of the bushing itself. In order to increase the support surface on the cable and/or not to damage the latter recourse has been had to inserting a small plate between the screw and the cable, which presents however the drawback of preventing the clamping of the plate until it contacts the bushing and hence the use of cables below a certain diameter. These known devices have undergone numerous improvements, for example, a decentering of the bore of the bushing has been contemplated and/or the inclination of the screw for the purpose of increasing the length of engagement of the latter. However, none of these devices provide any really effective holding of the cable nor do they prevent accidental loosening of the screw due to vibration or to creep of the cable.

Therefore in other devices both a clamping means and an elastic locking means have been included.

In a first device of this type, an elastic part, of spring steel for example, is inserted between the cable and the inner surface of the overlapping head of the clamping screw. From the start of screwing the cable is subjected to an increasing elastic pressure, and then the end of the screw comes into contact with the elastic part and commences direct clamping which is continued until locking. The elastic part then assumes a role similar to that of an elastic washer and resists loosening of the screw.

Other devices with clamping and elastic locking are constituted by a screw traversing the wall of the bushing freely through an opening, said screw being in engagement with a nut situated on the outside of the bushing. The nut is held against the bushing either by a non-distorting steel stirrup, or by an elastic steel ring, applied against the lateral surface of the bushing opposite the opening and having facing the latter an aperture designed for the passage of the screw whilst in the first case an elastic washer is interposed between the nut and a flat surface formed on the stirrup and in the second case the ring is applied against the outer surface of the nut.

These devices only ensure mediocre guidance of the screw and their assembly is often difficult since they comprise in the best cases, three elements in addition to the bushing: a ring, a nut and a screw.

When such a device is used as an electrical terminal, the use of a stirrup or of a steel ring causes a current transforming phenomenon which results in heating of the parts and a voltage drop in the conductor.

Moreover, in all known devices of which the plates and/or springs and/or screws are of steel the passage of current is effected principally at the point of contact of the conductor and of the bushing, which, for the most part is formed of cupriferous metal. Now it is quite obvious that any dirt or trace of oxidation in this contact area which is particularly difficult to clean, involves an additional electrical resistance which results in heating and poor current flow.

OBJECTS AND SUMMARY OF THE INVENTION

It is an object of the invention to provide an improved electrical connector which overcomes or reduces the above-mentioned drawbacks of prior art connectors.

Other objects and advantages will emerge from the following description.

Accordingly the invention provides an electrical terminal for holding a cable by clamping with elastic locking, characterised in that it comprises a core with a constant cross-section, an elastic ring of cross-section conjugate with that of said core and designed to encircle the latter and a clamping screw engaged in a diametric tapping of the core after having traversed a conjugate opening of the ring, whilst a longitudinal cavity of the core opening on its front surface and whose plane of symmetry passes through the axis of the tapping, defines with the inner surface of the ring, a housing for the bared end of the cable.

The invention thus enables the production of an elastic terminal of which the number of parts is less and which has all the properties of correct clamping, that is to say: elastic locking, maximum length of engagement of the screw and possible clamping to zero. In addition, in order to comply with certain standards the diameter of the screw is advantageously greater than that of the largest conductor which can be introduced into the housing provided in the bushing. Advantageously the three constituent parts: core, ring and screw are constituted of a material having good electrical conductivity, such as, for example, a cupriferous alloy.

Besides correct clamping and elastic locking due to the non-permanent deformation of the ring, the electrical contact between the terminal and the conductor or lead is established not only through the surface or line of contact of the conductor and the ring with passage to the core but also through the screw which transmits the current to the core through its threading over a good portion of its height. Considering that the screw is forcibly tightened on to the conductor, the contact surfaces: conductor — end of the screw, on the one hand, and the two conjugate threadings of the latter and of the core, on the other hand, are quite unsoiled and cleaned automatically in the course of tightening.

The longitudinal cavity of the core may be a fairly deep groove or again a diametric slot which permits in the latter case the production besides the elastic locking, of a wedging of the screw as will be discussed below.

It is another object of the invention to provide an improved elastic end pressure or butting contact and simplified method for making it. These are mostly used for equipping the bases of power sockets. For each contact, the rigid pin of the male element (or plug) cooperates with a contact head of the female element (or socket) and this contact head is connected to the electrical connector terminal which receives the current supply cable, through a deformable lead or metallic braid capable of undergoing longitudinal compression whilst a helicoidal spring surrounding said braid tends to separate the contact head from the electrical connector terminal. Thus by suitably selecting the assembly travel of the plug into the socket and/or the length of the pins of the plug, a longitudinal "squeezing" with spreading of the braids is produced whilst the spring ensures pressurised contact between the contact head and the end of the rigid pin.

The contact head and the terminal each carry on their facing surfaces, a crimping bushing receiving one of the ends of the metallic braid.

With the terminals at present known it is then necessary to effect the crimping of one of the ends of the braid on one of the elements, head or terminal, then to thread the helicoidal spring and then to compress the latter by means of a machine or a special tool to cause the outer end of the braid to project and thus permit the crimping of the bushing of the other element thereon.

With a terminal according to the invention, it suffices to select suitably the diameter of the core and the length of the elastic ring for this operation to be greatly simplified. The core must have a diameter corresponding to the internal diameter of the helicoidal spring at rest. It is then possible to effect crimping of the two ends of the braid in the absence of the spring, then to thread on the spring from the free end of the core until it is brought into abutment against the contact head. The ring is then threaded around the core by compressing the spring until the opening of the ring is brought into the axis of the tapping of said core and it is held in place by engaging the screw by several turns. It suffices to calculate the appropriate length of the ring to ensure the desired prestressing of the spring.

BRIEF DESCRIPTION OF THE DRAWING

The invention will be better understood on reading the following description of several preferred embodiments of an electrical terminal according to the invention with reference to the accompanying drawing in which.

DESCRIPTION OF THE PREFERRED EMBODIMENTS

Figure 1:
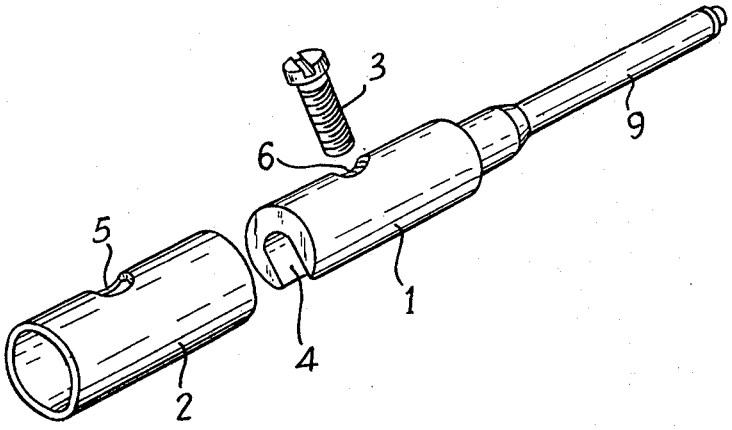
FIG. 1 shows in perspective the parts to be assembled, constituting one embodiment of an electrical terminal according to the invention.
Figure 2:
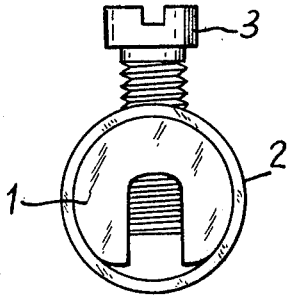
FIG. 2 is an end view of the assembled terminal of the embodiment of FIG. 1.
Figure 3:
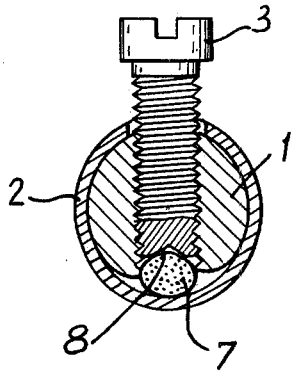
FIG. 3 is a cross-section of the embodiment of FIG. 1 at the level of the screw, the end of a bared cable being clamped between the screw and the elastic ring.

FIGS. 1 to 3 show an embodiment of an electrical terminal provided with a bushing constituted by a cylindrical core 1, a cylindrical elastic ring 2 and a clamping screw 3. The core 1 is provided with a longitudinal groove 4 of substantially U-shaped cross-section. The ring 2 is designed to engirdle or encircle the core 1 and to this end, its inner diameter is very slightly greater than the outer diameter of said core 1. The ring 2 and the core 1 are respectively provided with an opening 5 formed through the wall of the ring 2 and an opening 6, tapped in a manner conjugate with the threading of the screw, which traverses the core 1 opposite the groove 4, from one side to the other. The screw 3 is designed to be engaged in the two openings 5 and 6 aligned with one another on the positioning of the ring 2 around the core 1. Advantageously, the diameter of the screw 3 is substantially greater than the width of the groove 4, the tapping of the opening 6 in the core 1 being extended over the wings of said groove 4, whilst its length is a little greater than the diameter of the ring 2. Thus, not only is the screw 3 engaged over almost the whole of the length (FIG. 3) but it can be screwed in fully until it contacts the ring 2, in the absence of a conductor. This arrangement enables the use of any conductor such as conductor 7 (FIG. 3), whose diameter is at the most equal to the width of the groove 4. A conductor whose diameter is substantially equal to the above-mentioned width will then be suitably clamped by the screw 3 of larger diameter, which conforms notably with French Standard 62911.

The bared end of the conductor 7 inserted in the groove 4 is suitably clamped between the ring 2 and the screw 3. The latter is firstly screwed without resistance until it touches the conductor 7, then forced against the latter, thus slightly deforming the elastic ring which takes a substantially ovoid shape (FIG. 3). The tendency of the ring 2 to recover elastically its cylindrical initial shape, locks the clamping of the screw and avoids any loosening due notably to creep of the conductor.

In order to retain the conductor 7 even better in the thus constituted bushing, at the end of the screw 3 a central cavity 8 is formed. This cavity defines an annular reduced surface of the end of the screw, which enables a higher clamping pressure for a given torque and which creates a slight protuberance of the conductor into the cavity thus offering an additional resistance to the extraction of the cable.

The core 1 and the ring 2 are desirably formed of metals of good electrical conductivity such as copper or brass. The screw 3 is advantageously formed of a metal as least as good a conductor as those used for the core and the ring which enables the obtaining only for the passage of the current at the point of contact of the conductor 7 and of the ring 2 with return to the core 1, but especially at the point of contact of the conductor and of the end of the screw with return to said core 1 through the conjugate threads of the latter and of the screw. Benefit is thus derived from the contact surfaces which are cleaned automatically in the course of clamping. In fact, when the screw 3 is screwed into the tapping of the hole 6, the friction between the threads results in cleaning and even polishing of the latter. Similarly the rotation of the screw over the surface of the conductor creates a perfectly clean contact surface and free notably from traces of oxidation. Thus good conduction of the current is obtained, which is transmitted to a connector element such as the pin 9, FIG. 1, which extends the core 1.

In any case, it is important that all the parts constituting the electrical terminal should be constituted of an amagnetic material in order to avoid heating by transformation of the current.

Figure 4:
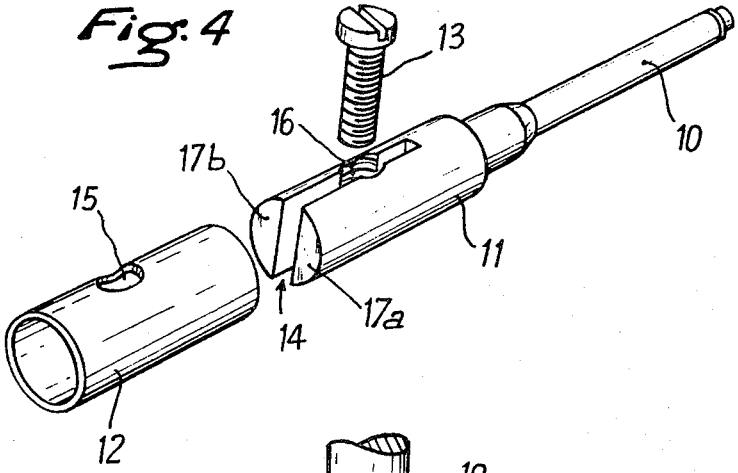
FIG. 4 is similar in view to FIG. 1 and shows another embodiment of a terminal according to the invention.

In FIG. 4, the terminal is that of a pin designed to equip, for example the male element or plug of an electrical connector. It is constituted by a cylindrical core 11 fast to the pin 10, by an elastic ring 12 and by a clamping screw 13. The core 11 is provided with a diametric slot 14. The ring 12 is designed to encircle the core 11 and its inner diameter is hardly greater than the outer diameter of said core. The wall of the ring 12 is provided with an opening 15 and the core 11 is provided with a tapping 16 corresponding to the threading of the screw 13 whose diameter is distinctly greater than the width of the slot 14 and whose axial length is a little greater than the diameter of the ring 12. The screw is designed to be screwed into the tapping 16 after having freely traversed the opening 15 aligned on said tapping when the ring is positioned on the core.

The bared end of a conductor, of any diameter but at the most equal to the width of the slot 14 being inserted in the latter is suitably clamped between the inner surface of the ring 12 and the end of the screw 13. The latter is first screwed without resistance until it touches the conductor, then forces the latter against the elastic ring slightly deforming the latter which takes a substantially ovoid shape (like the ring 2 of the terminal of FIGS. 1 to 3). The tendency of the ring to resume its initial shape ensures the elastic locking. However, at the same time the deformation of the ring exerts a pinching action on the wings 17*a*, 17*b* of the slot 14, which results in wedging of the screw 13 and improves its resistance to loosening. As has been stated, the end of the screw 13 comprises preferably a central cavity.

Figure 5:
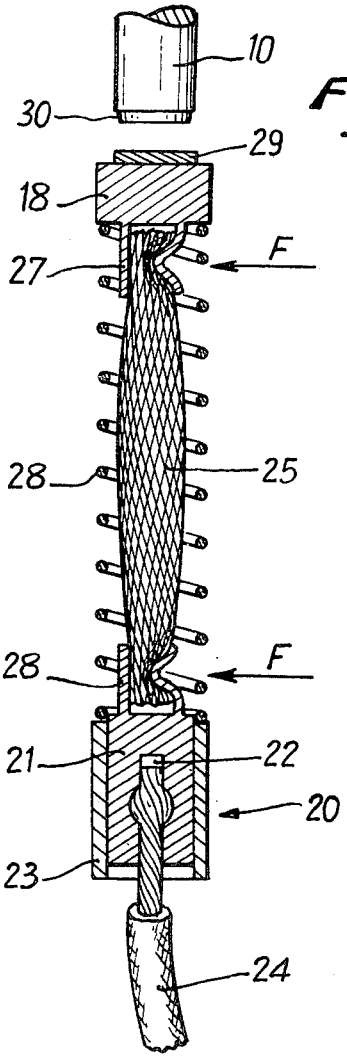
FIG. 5 shows in longitudinal section an embodiment of an elastic end pressure contact provided with a terminal according to FIG. 4.

In FIG. 5, an elastic end pressure contact is designed to cooperate with a rigid opposing pin 10 which can itself be equipped with a terminal according to the invention, as is shown in FIG. 4. The elastic contact comprises a head 18 and a terminal 20 similar to that equipping the rigid pin 10 in FIG. 4, with the core 21 including a diametric slot 22 and its elastic ring 23. In this Figure the screw passing through the opening of the ring and cooperating with the tapping of the core is removed for greater clarity, but the ring is shown in the relative position that is occupies with respect to the core when the screw is engaged in the tapping. The terminal 20 is designed to receive and to retain the bared end of a supply conductor 24.

The terminal 20 and the head 18 are connected electrically to the conductor 25 deformable by expansion, constituted by a metallic braid. For this, the opposite surfaces of the core and of the head bear crimping bushes, respectively 26 and 27 in which the ends of the braid 25 are crimped. A helicoidal spring 28 surrounds the braid 25 and is supported at its ends, with a prestressing of predetermined magnitude, on a shoulder of the head 18 and on the terminal 20.

The head 18 and the pin 10 each bear a contact stud of silver, respectively 29 and 30.

All the parts are of amagnetic material and of good electrical conductivity, such as silver for the studs 29 and 30, amagnetic steel for the spring 20, copper or brass for all the other parts. In order to improve the electrical performance of the contact, the volumes of the contact studs and of the contact head are increased as much as possible. In the same way, in order to obtain the largest "useful" cross-section of the braid for a given size, without risking during expansion the friction of the ends of the braid against the spring and their jamming in the spaces between the turns, said braid is preferably solidly plaited and not crown braided (tubular braid).

The core 21 has a slightly smaller diameter than the inner diameter of the spring 25 and the point of support of the latter against the terminal 20 is constituted by the corresponding front surface of the ring 23.

Thus the crimping of the ends of the braid 25 in the bushes 26 and 27 can be effected before the positioning of the spring, as has been stated above. This facilitates the work of crimping and the controlling of the voltage drops and reduces the cost price. This cost price is further reduced due to the fact that there is then no difficulty in effecting crimping by staving in the bushes, as is shown in FIG. 2 by the arrows F, which reduces rejects compared with axial crimping since the tolerance of the sides can be much greater.

Quite obviously the terminal shown in FIG. 5 could be identical with that of the type shown in FIG. 1.

I claim:

1. Electrical equipment terminal or connecting member for clamping and locking elastically the bared end of a supply or distribution cable, said terminal comprising a cylindrical core of constant cross-section, an elastic ring of cross-section conjugate with that of said core and adapted to encircle the core, and a clamping screw engaged in a diametric tapping from one side of the core after having traversed a conjugate opening in the ring, a longitudinal cavity of the core extending from its side opposite the tapping and whose plane of symmetry passes through the axis of the tapping defining, with a portion of the inner surface of the ring, a housing to conductively contact the bared end of the cable.

2. Electrical terminal according to claim 1, wherein said cavity is constituted by a deep groove of substantially U-shaped cross-section.

3. Electrical terminal according to claim 2, wherein said tapping of the core has a greater diameter than the width of said groove, said tapping being extended on the wings of said groove.

4. Electrical terminal according to claim 1, wherein the cavity is formed by a diametric longitudinal slot of the core extending over a part of the width of the latter from its free end to beyond the tapping and the diameter of the tapping is much greater than the width of said slot.

5. Electrical terminal according to claim 1, constituting the terminal of an elastic end pressure contact, comprising a contact head, a deformable conductor connecting said terminal and said contact head, a helicoidal spring surrounding said deformable conductor and supported on a shoulder of said contact head and on said terminal, wherein the core has a diameter conjugate with the inner diameter of the spring at rest and the ring forms the support element of the spring on the terminal, its length being calculated according to the desired prestressing for said spring.

6. Electrical terminal according to claim 1, wherein all the constituent parts are amagnetic and have good electrical conductivity.

7. Electrical equipment terminal according to claim 2, constituting the terminal of an elastic end pressure contact, comprising a contact head, a deformable conductor connecting said terminal and said contact head, a helicoidal spring surrounding said deformable conductor and supported on a shoulder of said contact head and on said terminal, wherein the core has a diameter conjugate with the inner diameter of the spring at rest and the ring forms the support element of the spring on the terminal, its length being calculated according to the desired prestressing for said spring.

8. Electric equipment terminal according to claim 3, constituting the terminal of an elastic end pressure contact, comprising a contact head, a deformable conductor connecting said terminal and said contact head, a helicoidal spring surrounding said deformable conductor and supported on a shoulder of said contact head and on said terminal, wherein the core has a diameter conjugate with the inner diameter of the spring at rest and the ring forms the support element of the spring on the terminal, its length being calculated according to the desired prestressing for said spring.

9. Electric equipment terminal according to claim 4, constituting the terminal of an elastic end pressure contact, comprising a contact head, a deformable conductor connecting said terminal and said contact head, a helicoidal spring surrounding said deformable conductor and supported on a shoulder of said contact head and on said terminal, wherein the core has a diameter conjugate with the inner diameter of the spring at rest and the ring forms the support element of the spring on the terminal, its length being calculated according to the desired prestressing for said spring.

10. Electric equipment terminal according to claim 5, wherein all the constituent parts are amagnetic and have good electrical conductivity.

* * * * *